US011920266B2

(12) United States Patent
Qiu

(10) Patent No.: US 11,920,266 B2
(45) Date of Patent: Mar. 5, 2024

(54) CONVOLUTE WOVEN SLEEVE AND METHOD OF CONSTRUCTION THEREOF

(71) Applicant: FEDERAL-MOGUL POWERTRAIN LLC, Southfield, MI (US)

(72) Inventor: Xiaodan Qiu, Downingtown, PA (US)

(73) Assignee: Federal-Mogul Powertrain LLC, Southfield, MI (US)

( * ) Notice: Subject to any disclaimer, the term of this patent is extended or adjusted under 35 U.S.C. 154(b) by 175 days.

(21) Appl. No.: 17/641,686

(22) PCT Filed: Sep. 2, 2020

(86) PCT No.: PCT/US2020/048992
§ 371 (c)(1),
(2) Date: Mar. 9, 2022

(87) PCT Pub. No.: WO2021/050330
PCT Pub. Date: Mar. 18, 2021

(65) Prior Publication Data

US 2022/0290339 A1 Sep. 15, 2022

Related U.S. Application Data

(60) Provisional application No. 62/898,457, filed on Sep. 10, 2019.

(51) Int. Cl.
*D03D 3/02* (2006.01)
*D03D 1/00* (2006.01)
*D03D 13/00* (2006.01)

(52) U.S. Cl.
CPC ..... *D03D 3/02* (2013.01); *D03D 1/0043* (2021.05); *D10B 2403/033* (2013.01)

(58) Field of Classification Search
CPC ..... D03D 3/02; D03D 1/0043; D03D 1/0035; D10B 2403/033
See application file for complete search history.

(56) References Cited

U.S. PATENT DOCUMENTS 3,466,210 A 9/1969 Wareham
5,763,032 A 6/1998 Hutt
(Continued)

FOREIGN PATENT DOCUMENTS

CN 103109008 A 5/2013
EP 1775811 A1 4/2007
(Continued)

*Primary Examiner* — Robert H Muromoto, Jr.
(74) *Attorney, Agent, or Firm* — Robert L. Stearns; Dickinson Wright PLLC

(57) ABSTRACT

A corrugated protective textile sleeve has a flexible, tubular wall of woven warp yarns, extending lengthwise along a longitudinal axis between opposite ends of the wall, and weft yarns, extending generally transversely to the warp yarns. At least some of the weft yarns are activatable weft yarn to shrink in length and at least some the weft yarns, adjacent the activatable weft yarn, are substantially non-activatable weft yarn. The substantially non-activatable weft yarn form crests, having a first diameter, spaced axially from one another and the activatable weft yarns, upon being activated and shrunken, form valleys, having a second diameter less than the first diameter, with at least some of the valleys extending between the crests to form the wall having a corrugated contour.

20 Claims, 2 Drawing Sheets

(56) References Cited

U.S. PATENT DOCUMENTS 6,045,884 A * 4/2000 Hess ..... D03D 15/593 428/36.1
6,051,291 A * 4/2000 Gladfelter ..... F16L 59/08 428/36.1
6,309,721 B1 * 10/2001 Gladfelter ..... B60R 13/08 428/36.1
6,328,080 B1 * 12/2001 Winters ..... D03D 19/00 428/36.1
6,610,928 B2 * 8/2003 Synder ..... H02G 3/0487 174/72 A
6,774,312 B2 * 8/2004 Fatato ..... F16L 57/00 174/74 A
6,963,031 B2 11/2005 Gladfelter et al.
6,974,169 B1 * 12/2005 Upton ..... F16L 55/1652 254/134.3 FT
7,523,532 B2 * 4/2009 Yamaguchi ..... B60R 16/0215 28/142
8,021,051 B2 * 9/2011 James ..... D03D 15/283 384/282
8,152,380 B2 * 4/2012 Lien ..... F16C 33/201 384/298
8,283,563 B2 * 10/2012 Harris ..... D03D 1/0041 174/117 M
8,455,080 B2 * 6/2013 Baer ..... B32B 5/024 428/36.1
8,701,716 B2 * 4/2014 Kashihara ..... D03D 15/283 139/384 R
8,728,152 B2 5/2014 Goldmann et al.
9,028,937 B2 * 5/2015 Harris ..... B32B 3/10 428/36.1
9,290,876 B2 * 3/2016 Marcellin ..... D03D 1/0043
9,307,685 B2 * 4/2016 Harris ..... D04C 1/06
9,416,469 B2 * 8/2016 Woodruff ..... D03D 15/283
9,695,962 B2 * 7/2017 Chen ..... F16L 57/04
9,909,237 B2 * 3/2018 Woodruff ..... D03D 1/0041
9,913,415 B2 * 3/2018 Harris ..... H05K 9/009
10,132,012 B2 11/2018 Thomas et al.
10,155,424 B1 * 12/2018 Elterman ..... B60G 7/001
10,208,410 B2 2/2019 Gao et al.
10,315,379 B2 * 6/2019 Woodruff ..... D03D 15/547
10,357,933 B2 * 7/2019 Malloy ..... H02G 3/0412
10,393,307 B2 * 8/2019 Laurent ..... F16L 57/06
10,538,866 B2 * 1/2020 Kaing ..... D03D 23/00
10,542,645 B2 * 1/2020 Simoens-Seghers ..... H05K 9/0067
10,578,001 B2 * 3/2020 Galamba ..... B32B 1/08
10,615,581 B2 * 4/2020 Knudson ..... H05K 9/009
10,632,939 B2 * 4/2020 Yoshimura ..... D03D 11/00
10,675,832 B2 * 6/2020 Liu ..... D03D 15/43
10,807,341 B2 * 10/2020 DePompeo ..... B32B 1/08
10,840,681 B2 * 11/2020 Galamba ..... H02G 3/0412
11,168,415 B2 * 11/2021 Henin ..... H02G 15/1813
11,180,872 B2 * 11/2021 Qiu ..... D03D 15/587
11,268,217 B2 * 3/2022 Woodruff ..... D03D 15/00
11,305,508 B2 * 4/2022 Kaing ..... D03D 3/02
11,332,856 B2 * 5/2022 Malloy ..... D03D 3/005
11,401,631 B2 * 8/2022 Yoneshige ..... B32B 5/024
11,686,022 B2 * 6/2023 Yoneshige ..... H02G 3/0468 428/36.1
2003/0089971 A1 5/2003 Akers et al.
2004/0081411 A1 * 4/2004 Gladfelter ..... F16L 57/00 385/100
2004/0219846 A1 * 11/2004 Sellis ..... B32B 15/08 442/151
2005/0185902 A1 * 8/2005 James ..... G02B 6/4459 385/100
2006/0016507 A1 * 1/2006 Baer ..... H02G 15/18 139/383 R
2007/0095552 A1 * 5/2007 Thierolf ..... H01B 7/0861 174/36
2007/0166495 A1 * 7/2007 Sellis ..... D03D 15/587 428/36.1
2012/0037263 A1 2/2012 Malloy
2013/0037159 A1 2/2013 Kramer, Jr. et al.
2013/0199656 A1 * 8/2013 Sherwin ..... F16L 11/11 138/140
2013/0206275 A1 * 8/2013 Itoh ..... D03D 15/283 139/35
2013/0228248 A1 * 9/2013 Malloy ..... D03D 1/0043 139/35
2014/0090739 A1 * 4/2014 Harris ..... D03D 15/47 139/35
2014/0220846 A1 * 8/2014 Woodruff ..... D03D 41/00 139/420 R
2014/0255627 A1 * 9/2014 Yamaguchi ..... H02G 3/0468 428/34.1
2014/0256202 A1 * 9/2014 Laurent ..... D06H 5/002 442/304
2014/0262476 A1 * 9/2014 Laurent ..... H05K 9/0007 174/379
2014/0262478 A1 * 9/2014 Harris ..... D03D 15/567 139/420 R
2014/0272218 A1 * 9/2014 Thomas ..... D03D 1/0041 428/35.1
2014/0273698 A1 * 9/2014 Woodruff ..... D03D 1/0041 139/420 R
2014/0305536 A1 * 10/2014 Gao ..... H05B 3/03 139/291 C
2015/0093556 A1 * 4/2015 Woodruff ..... B32B 1/08 156/60
2016/0122916 A1 5/2016 Fathallah et al.
2018/0057977 A1 * 3/2018 Zhang ..... D04B 1/12
2018/0057982 A1 * 3/2018 Qiu ..... D02G 3/38
2018/0062364 A1 * 3/2018 Qiu ..... D03D 3/02
2018/0119869 A1 5/2018 Laurent et al.
2019/0211482 A1 * 7/2019 Kaing ..... D03D 15/567
2021/0123168 A1 * 4/2021 Yoneshige ..... B32B 5/263
2021/0249848 A1 * 8/2021 Yoneshige ..... H02G 3/0468
2022/0186408 A1 * 6/2022 Qiu ..... H02G 3/0481
2022/0290339 A1 * 9/2022 Qiu ..... D03D 1/0043
2023/0014166 A1 * 1/2023 Mehbubani ..... D06N 3/0006

FOREIGN PATENT DOCUMENTS

JP 2000274527 A 10/2000
JP 2015063763 A 4/2015
WO 2013111877 A1 8/2013

* cited by examiner

FIG. 1
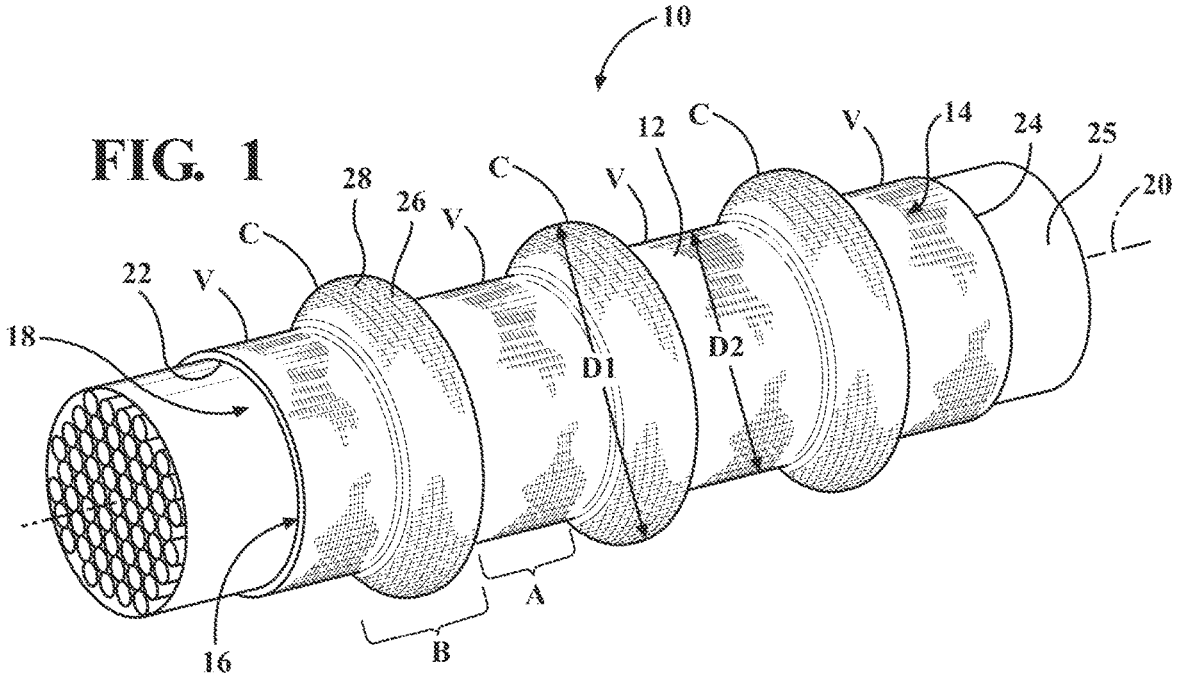
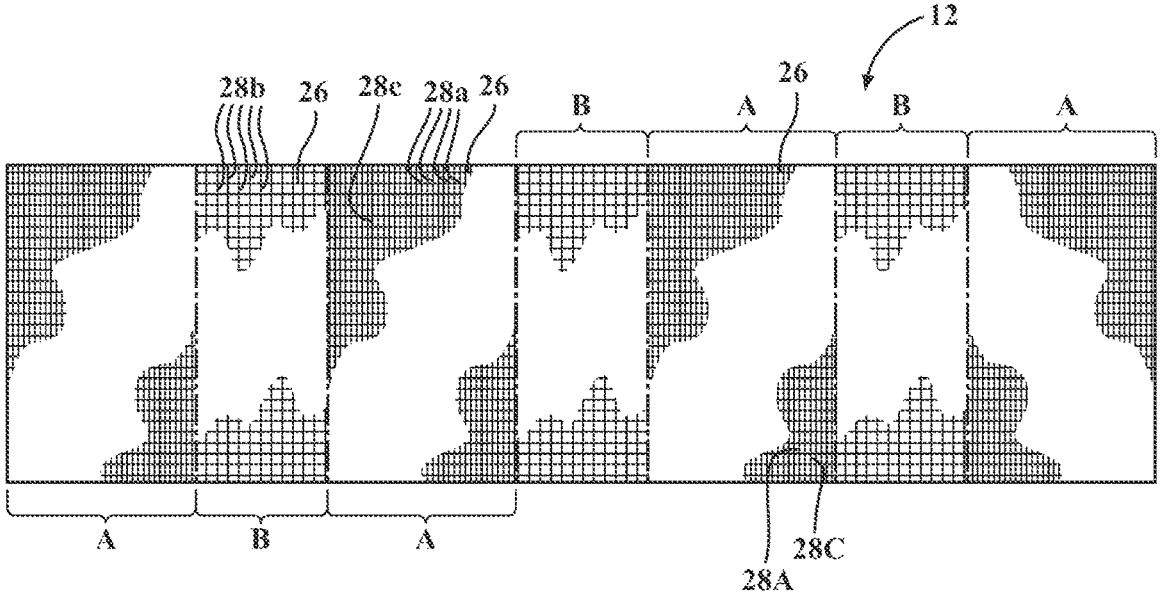
FIG. 2

CONVOLUTE WOVEN SLEEVE AND METHOD OF CONSTRUCTION THEREOF

CROSS-REFERENCE TO RELATED APPLICATION

This U.S. National Phase Application claims the benefit of U.S. International Patent Application No. PCT/US2020/048992, filed Sep. 2, 2020, which claims priority to U.S. Provisional Application Ser. No. 62/898,457, filed Sep. 10, 2019, both of which are incorporated herein by reference in their entirety.

BACKGROUND OF THE INVENTION

1. Technical Field

This invention relates generally to textile sleeves for protecting elongate members, and more particularly to woven, corrugated textile sleeves.

2. Related Art

Woven sleeves are known for use to provide protection to internally contained elongate members, such as wire(s), wire harnesses, fluid or gas conveying tubes, or cables, for example. Modern vehicle and aerospace applications for such sleeves are requiring greater protection to the elongate members, such as against increased environmental temperatures, increased resistance to abrasion, increased acoustic performance via resistance to causing noise, and are further requiring enhanced flexibility due to having to be routed over tightly confined meandering paths. While being routed over a meandering path, it has been found to be important to resist kinking a wall of the sleeve. Kinking the sleeve wall can potentially damage and/or reduce the functional performance of elongate member(s) being protected by the sleeve. These desired increased functional requirements require the sleeves to pass increasingly stringent test parameters, such as exposure to increased temperatures, exposure to specifically defined abrasion/acoustic test specifications, and exposure to flex/anti-kink tests. Meanwhile, it is important to have the sleeve be economical in manufacture and in assembly, as well as in use, while at the same time exhibit a long and useful life.

A woven sleeve constructed in accordance with this invention is able to meet the increasingly demanding temperature, acoustic and abrasion resistant test parameters, as well as demonstrate greatly enhanced flexibility without kinking, with other benefits being readily recognized by those possessing ordinary skill in the art, such as being economical in manufacture and in assembly, as well as in use, while at the same time exhibit a long and useful life.

SUMMARY OF THE INVENTION

A textile sleeve having a flexible, abrasion resistant, thermally protective, acoustic sensitive wall of woven yarns is provided. At least some circumferentially extending weft yarn(s) of the wall are activatable to shrink, with other circumferentially extending weft yarn(s) of the wall adjacent the activatable weft yarns remaining non-activatable or substantially non-activatable such that they do not shrink (non-activatable) or shrink only a small percentage (substantially non-activatable) compared to the activatable weft yarns, e.g. 1-10% compared to the shrinkage of the activatable yarn(s), and provide the wall with a permanent corrugated shape. The corrugated shape of the wall, formed after activating the activatable circumferentially extending weft yarn(s), provides the wall having crests spaced axially from one another by valleys. The crests are formed as a result of including only the non-activatable or substantially non-activatable weft yarn(s), while the valleys are formed as a result of including the activatable weft yarn(s). The corrugated shape provides the wall with an increased hoop strength and a greatly enhanced flexibility such that the sleeve can be routed about tight meandering paths, including sharp bends and corners, without kinking. Accordingly, the elongate member being protected within a cavity of the sleeve avoids being damaged or having its performance compromised by kinks and receives greatly enhanced protection against a multitude of conditions, including abrasion and environmental thermal effects, as well as being protected against potential damage from impact forces, such as from flying debris impacting the outer surface of the sleeve (e.g. stone impingement and the like), while also having desired acoustical properties.

In accordance with another aspect of the disclosure, the wall can be formed being circumferentially continuous and seamless.

In accordance with another aspect of the disclosure, the wall can be formed as a wrappable sleeve, having opposite lengthwise extending edges configured to be wrapped into overlapping relation with one another.

In accordance with another aspect of the disclosure, the wall can include heat-settable weft yarn(s), such that upon being heat-set (also referred to as heat-formed or heat-shaped), the heat-set yarn(s) biases and maintains opposite lengthwise extending edges in wrapped, overlapping relation with one another, whereupon the opposite edges can be selectively and intentionally spread apart from one another to allow access to an internal cavity, and then release to automatically return to their overlapping relation with one another to circumferentially bound the cavity and protect the elongate member(s) contained therein.

In accordance with another aspect of the disclosure, the activatable weft yarn(s), in entirety or in part, can include monofilaments.

In accordance with another aspect of the disclosure, the activatable weft yarn(s), in entirety or in part, can include multifilaments.

In accordance with another aspect of the disclosure, the non-activatable weft yarn(s) can include monofilaments to enhance abrasion resistance.

In accordance with another aspect of the disclosure, the non-activatable weft yarn(s) can include multifilaments to enhance softness, increase protection against the ingress of contamination, increase thermal protection and impact resistance.

In accordance with another aspect of the disclosure, the wall can include an outer reflective layer to enhance thermal protection of the elongate member(s) contained within the sleeve.

In accordance with another aspect of the disclosure, the outer reflective layer can include a layer of metal foil bonded to an outer surface of the woven wall, with the thickness of the metal foil being selected to allow the wall to take on a corrugated shape upon activating the activatable weft yarn (s).

In accordance with another aspect of the disclosure, the axially extending length of each valley and of each crest can be provided as desired (customized) by controlling the number of picks of the respective activatable and non-activatable yarns within each valley and within each crest, thereby being able to provide enhanced flex regions of corrugated shape uniformly spaced from one another along the entire length of the sleeve or non-uniformly spaced from one another and located along specific regions of the sleeve, thereby being able to provide an ability of the sleeve to bend and meander where needed. Accordingly, the use of more expensive activatable yarn(s) in regions of the sleeve not requiring an ability to be bent can be avoided, thus, providing the sleeve with the desired performance characteristics, while remaining economical in manufacture and in use.

In accordance with another aspect of the disclosure, the weave pattern used to weave the wall can be a plain weave, twill, satin, sateen, basket, or otherwise, as desired to attain the desired performance characteristics.

In accordance with another aspect of the disclosure, the activatable weft yarn(s) can be provided as being activatable by heat, fluid, and/or radiation.

In accordance with another aspect of the disclosure, a corrugated protective textile sleeve is provided including a flexible, tubular wall of warp yarns and weft yarns woven with one another. The warp yarns extend lengthwise along a longitudinal axis between opposite ends of the tubular wall and the weft yarns extend generally transversely to the warp yarns. At least some of the weft yarns are activated to a shrunken length (relative to their length "as initially woven") and at least some the weft yarns are non-activated to retain their length as initially woven. The non-activated weft yarns form crests, having a first diameter, spaced axially from one another and the activated weft yarns form valleys, having a second diameter less than the first diameter, with at least some of the valleys extending between at least some of the crests.

In accordance with another aspect of the disclosure, a method of constructing a corrugated textile sleeve for protecting an elongate member contained therein is provided. The method includes: weaving a wall having a plurality of first bands and a plurality of second bands alternating with one another along a length of the sleeve. Further, weaving the first bands including circumferentially extending weft yarn(s) that are activatable to shrink in length and weaving the second bands including circumferentially extending weft yarn(s) that are non-activatable or substantially non-activatable such that they do not shrink or shrink only a small percentage in length compared to the activatable weft yarns. Then, activating the activatable yarn(s) and causing the activatable yarn(s) to shrink, while causing the non-activated yarn(s) to retain or substantially retain an "as woven" length, thereby forming the wall having a corrugated shape, with radially outwardly extending crests being formed by the non-activatable or substantially non-activatable weft yarn(s) and radially inwardly extending valleys being formed by the shrunk, activated weft yarn(s).

In accordance with another aspect of the disclosure, the method can further include weaving the wall being circumferentially continuous and seamless.

In accordance with another aspect of the disclosure, the method can further include weaving the wall being wrappable, having opposite lengthwise extending edges configured to be wrapped into overlapping relation with one another.

In accordance with another aspect of the disclosure, the method can further include weaving the wall including heat-settable weft yarn(s), such that upon being heat-set, the heat-set yarn(s) bias and maintain opposite lengthwise extending edges in wrapped, overlapping relation with one another.

In accordance with another aspect of the disclosure, the method can further include weaving the activatable weft yarn(s) including monofilaments and/or multifilaments.

In accordance with another aspect of the disclosure, the method can further include weaving the non-activatable weft yarn(s) including monofilaments and/or multifilaments.

In accordance with another aspect of the disclosure, the method can further forming an outer reflective layer on an outer surface of the woven wall to enhance thermal protection of the elongate member(s) contained within the sleeve.

In accordance with another aspect of the disclosure, the method can further include providing the outer reflective layer include a layer of metal foil.

In accordance with another aspect of the disclosure, the method can further include bonding the layer of foil to an outer surface of the woven wall and providing the thickness of the metal foil to allow the wall to take on a corrugated shape upon activating the activatable weft yarn(s).

In accordance with another aspect of the disclosure, the method can further include selectively controlling the number of picks of the activatable and non-activatable yarns within each respective valley and within each crest, thereby being able to form the axially extending length of each valley and each crest as desired, to provide enhanced flex regions of corrugated shape uniformly along the entire length of the sleeve or non-uniformly and along specific regions of the sleeve, thereby being able to provide an ability of the sleeve to bend and meander only where needed.

In accordance with another aspect of the disclosure, the method can further include weaving the wall having one of the following weave patterns, plain, twill, satin, sateen, basket, or otherwise, as desired to attain the desired performance characteristics.

In accordance with another aspect of the disclosure, the method can further include providing the activatable weft yarn(s) being activatable by at least one of heat, fluid, and/or radiation.

BRIEF DESCRIPTION OF THE DRAWINGS

These and other aspects, features and advantages of the disclosure will become readily apparent to those skilled in the art in view of the following detailed description of the presently preferred embodiments and best mode, appended claims, and accompanying drawings, in which:

FIG. 1 is a schematic perspective view of a woven protective textile sleeve constructed in accordance with one aspect of the disclosure shown protecting an elongate member extending therethrough;

FIG. 2 is a side plan view of the sleeve of FIG. 1 shown prior to activating activatable weft yarns within the wall of the sleeve;

DETAILED DESCRIPTION OF PREFERRED EMBODIMENTS

Figure 3:
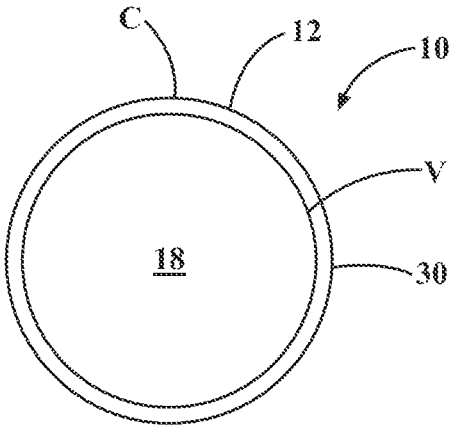
FIG. 3 is a schematic end view of the sleeve of FIG. 1.
Figure 4:
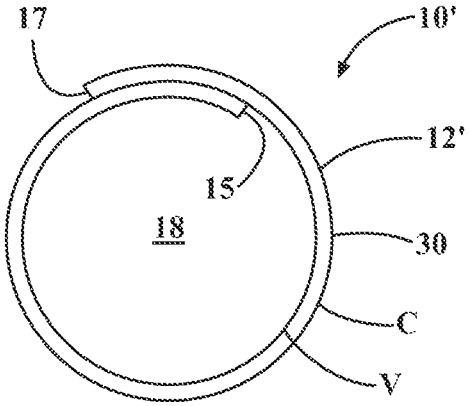
FIG. 4 is a view similar to FIG. 3 showing a wrappable sleeve constructed in accordance with another aspect of the disclosure.

Referring in more detail to the drawings, FIG. 1 illustrates a woven tubular textile sleeve 10 constructed in accordance with one aspect of the disclosure. The sleeve 10 has a flexible tubular wall 12 that is abrasion resistant, thermally protective, and acoustically protective. The wall 12 can be woven in seamless fashion, having a circumferentially continuous, uninterrupted outer surface 14 (FIG. 3) having an inner surface 16 that defines an inner tubular cavity 18 that extends axially along a central longitudinal axis 20 between opposite ends 22, 24 of the sleeve 10, or in another embodiment, the sleeve 10' can be formed as a wrappable wall 12' (FIG. 4) having opposite lengthwise extending edges 15, 17 configured to be wrapped into overlapping relation with one another. The cavity 18 is sized for receipt of an elongate member 25 to be protected, such as a wire harness, fluid or gas conveying conduit, cable or the like, there-through. The wall 12 (discussion hereafter for wall 12 also applies to wall 12' unless expressly stated otherwise) includes warp yarns 26, extending lengthwise in generally parallel relation with the central longitudinal axis 20 between the opposite ends 22, 24, and weft yarns 28, extending generally transversely to the warp yarns 26. At least some weft yarns 28 are activatable weft yarn 28*a*, wherein activatable is intended to mean that the yarn 28*a* can be activated to shrink in length, and at least some the weft yarns 28, adjacent the activatable weft yarn 28*a*, are non-activatable or substantially non-activatable weft yarn 28*b*. The non-activatable weft yarn 28*b* (also intended to include substantially non-activatable weft yarn hereafter, meaning upon activating the activable weft yarn 28*a*, the non-activatable weft yarn 28*b* do not shrink in length, or, with substantially, only shrink in length about 5% percent of their original length) form crests C, having a first diameter D1, spaced axially from one another, and the activatable weft yarns 28*a*, upon being activated and shrunken, form valleys V, having a second diameter D2 less than the first diameter D1, with at least some of the valleys V being formed to extend between axially spaced crests C to provide the sleeve 10 with its axially undulating, corrugated contour (FIG. 1).

Figure 2A:
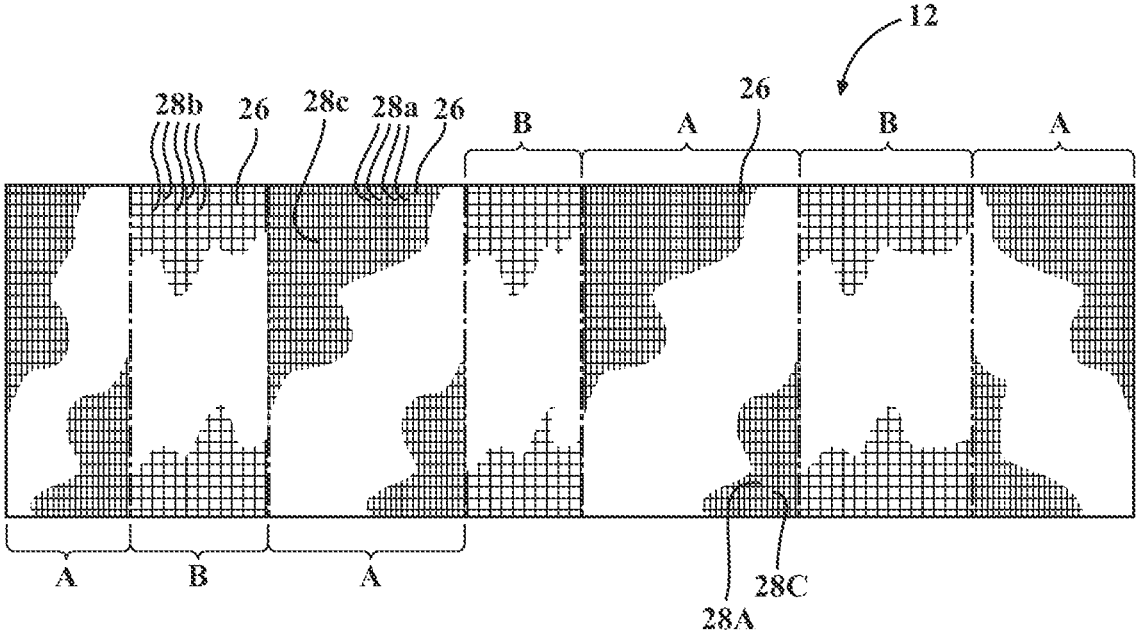
FIG. 2A is a view similar to FIG. 2 of a sleeve constructed in accordance with another aspect of the disclosure.

The valleys V and the crests C can be formed having axially extending lengths as desired by controlling the number of picks of the respective weft yarn 28*a*, 28*b* within each valley V and crest C, with each valley V and each crest C having a plurality of picks of weft yarns 28 therein, with the plurality of picks in the valleys V forming bands A and the plurality of picks in the crests C forming bands B. Accordingly, each of the bands A and valleys V formed thereby can be formed having the same length (equal number of picks in each band A; FIG. 2), or varying lengths (unequal number of picks in at least some or all of the bands A; FIG. 2A), relative to one another, as desired. Similarly, each of the bands B and crests C formed thereby can be formed having the same length (equal number of picks in each band B; FIG. 2), or varying lengths (unequal number of picks in at least some or all of the bands B; FIG. 2A), relative to one another, as desired. The wall 12, with the warp yarns 26 and weft yarns 28 being selectively provided as desired, whether monofilaments and/or multifilaments, as discussed in more detail hereafter, results in increased protection against abrasion, thermal effects, and impact forces, as well as providing a greatly enhance noise absorption capacity without need for additional layers, though, to further enhance thermal protection, and outer reflective layer 30 can be provided. Further, with the wall 12 having a corrugated configuration, greatly enhanced hoop strength and flexibility is attained without concern of kinking when routing the sleeve 10 about meandering paths and about sharp bends, corners and the like.

The wall 12 can be constructed having any suitable length and inner diameter. With the wall 12 providing multiple facets of increased protection, including abrasion resistance, thermal protection, impact resistance, noise absorption, as well as enhanced flexibility, the sleeve 10 is made cost effective given its ability to provide full protection to the elongate member 25 by itself without need of additional wall layers or a secondary coating materials beyond that provided by the single layer wall 12, though, if desired, an outer reflective layer 30 can be provided on the outer surface 14 of the wall 12, such as layer of metal foil, which can be simply wrapped spirally or in cigarette fashion, and bonded, if desired, to the outer surface 14. The non-activatable yarn 28*b* can be provided as monofilaments and/or multifilaments of any desired material, wherein multifilaments, if used, provide enhanced coverage and dampening (impermeability to contamination and dampening of noise and vibration) to the wall 12. The activatable yarn 28*a* can also be provided as monofilaments and/or multifilaments of any desired shrinkable material, wherein multifilaments, if used, provide enhanced coverage and dampening, and monofilaments, if used, provide enhance resistance to abrasion. It is to be understood that the warp yarns 26 can also be provided as monofilaments and/or multifilaments of any desired size and material.

In construction, regardless of the type(s) of yarns used, also referred to as filaments, as shown in FIG. 2, the wall 12 is woven initially as a straight cylindrical, non-corrugated wall 12 (or a flat wall for the wrappable wall 12'). Upon weaving the wall 12, the activatable weft yarns 28*a* of the wall 12 are activated to produce the radially outwardly extending crests C and the radially inwardly extending valleys V. Activation of the activatable weft yarns 28*a* can be prior to disposing the elongate member 25 in the cavity 18 or after, as desired. Upon activating the weft yarns 28*a*, the wall 12 is maintained in the resilient corrugated configuration via a permanent set, such as heatshrunken, wherein the activatable weft yarns 28*a* are heat-shrinkable, and thus, the wall 12 remains in the corrugated configuration during use. It is to be recognized that in application, if desired, the wall 12 can be stretched axially against the bias exerted by the wall 12 and then fixed in place about the elongate member 26 to be protected, via any suitable supplemental fastener, including tape, tie-wraps, and the like, and thus, the length of the sleeve 10 is adjustable to accommodate elongate members of different length.

If the wall 12' is woven as a wrappable sleeve, in addition to the activatable weft yarn 28*a* and the non-activatable weft yarn 28*b*, or in lieu of the non-activatable weft yarn 28*b*, heat-settable weft yarn 28*c* can be included. In particular, heat-settable weft yarn 28*c* can be included in the bands A and/or B, such that upon wrapping the opposite edges 15, 17 into overlapping relation with one another, the wall 12' can be heated in a suitable heat-treatment process to impart a permanent heat-set into the weft yarn 28*c*, thereby causing the heat-set weft yarn 28*c* to impart a permanent bias on the wall 12' to maintain the wall 12' in its wrapped configuration. Of course, a suitable bias can be applied to the edges 15, 17 to open the wall 12' for insertion or removal of the elongate member 25 relative to the cavity 18. The heat-treat process used to heat-set the weft yarn(s) 28*c* could be the same heating process used to activate the activatable weft yarn 28*a*, if desired, thereby stream-lining manufacture and reducing the associated cost of manufacture. Otherwise, the heat-setting process used for heat-settable yarn 28*c* could be a separate process used for activating the activatable weft yarn 28*a*, such that the wall 12' could first be heat-treated to take on its self-wrapping configuration, and then, in a subsequent process, the activable weft yarn 28*a* can be activated, such as in another heat-treat process, by way of example and without limitation, to cause the wall 12' to take on its corrugated configuration. Thus, it is contemplated that the heat-settable weft yarn 28*c* could be provided to become heat-set at a first temperature, while the activatable weft yarn 28*a* could be provided to become activated at a second temperature, wherein the second temperature is higher than the first temperature. Accordingly, the heat-settable weft yarn 28*c* can be heat-set without activating the activatable weft yarn 28*a*.

In accordance with another aspect of the disclosure, a method of constructing a corrugated textile sleeve 10, 10' is provided. The method includes weaving a flexible wall 12, 12' of including warp yarns 26, extending lengthwise in generally parallel relation along a longitudinal axis 20 between opposite ends 22, 24 of the wall 12, 12', and weft yarns 28, extending generally transversely to the warp yarns 26. Some of the weft yarns 28 are provided as being activatable weft yarn 28*a* and some of the weft yarns 28, adjacent the activatable weft yarn 28*a*, are provided as being substantially non-activatable weft yarn 28*b*. The method further includes forming the wall 12, 12' having a tubular configuration. Then, the method includes activating the activatable weft yarn 28*a* and causing the substantially non-activatable weft yarn 28*b* to form crests C, having a first diameter D1, spaced axially from one another, and causing the activated weft yarn 28*a* to be shrunken in length and constricted circumferentially to form valleys V, having a second diameter D2 less than the first diameter D1, with at least some of the valleys V extending between the crests C to provide the wall 12, 12' with a corrugated shape.

The method can further include weaving the wall 12 being circumferentially continuous and seamless.

The method can further include weaving the wall 12' having opposite lengthwise extending edges 15, 17 extending generally parallel to the longitudinal axis 20, with the edges 15, 17 being configured to be wrapped into overlapping relation with one another.

The method can further include heat-setting at least some of the weft yarn 28*c* to bias and maintain the opposite edges 15, 17 in wrapped, overlapping relation with one another.

The method can further include providing at least some of the activatable weft yarn 28*a* being monofilaments and/or providing at least some of the activatable weft yarn 28*a* being multifilaments.

The method can further include providing at least some of the non-activatable weft yarn 28*b* being monofilaments and/or providing at least some of the non-activatable weft yarn 28*b* being multifilaments.

The method can further include forming an outer reflective layer 30 on an outer surface of the wall 12, 12'.

The method can further include providing the outer reflective layer including a layer of metal foil 30.

The method can further include bonding the layer of metal foil 30 to the outer surface of the wall 12, 12' either before or after forming the crests C and valleys V.

The method can further include forming an axially extending length of each valley V and of each crest C by controlling the number of picks of the respective activatable and non-activatable yarns 28*a*, 28*b* within each valley V and within each crest C.

The method can further include weaving the wall 12, 12' having one of a plain weave pattern, twill weave pattern, satin weave pattern, sateen weave pattern, or basket weave pattern, with the aforementioned weave patterns being understood by one possessing ordinary skill in the textile art.

The method can further include providing the activatable weft yarn 28*a* being activatable by at least one of heat, fluid, and/or radiation.

The method can further include providing the activatable weft yarn 28*a* being activatable shrink by heat.

Obviously, many modifications and variations of the present invention are possible in light of the above teachings. It is contemplated that all features of all claims and of all embodiments can be combined with each other, so long as such combinations would not contradict one another. It is, therefore, to be understood that within the scope of the appended claims, the invention may be practiced otherwise than as specifically described.

What is claimed is:

1. A corrugated protective textile sleeve, comprising:

a flexible, tubular wall of woven warp yarns, extending lengthwise along a longitudinal axis between opposite ends of said tubular wall, and weft yarns, extending generally transversely to said warp yarns, at least some of said weft yarns being activatable weft yarn to shrink in length and at least some said weft yarns, adjacent said activatable weft yarn, being substantially non-activatable weft yarn, said substantially non-activatable weft yarn forming crests, having a first diameter, spaced axially from one another and said activatable weft yarns, upon being activated and shrunken, forming valleys, having a second diameter less than said first diameter, at least some of said valleys extending between said crests.

2. The corrugated protective sleeve of claim 1, wherein said wall is circumferentially continuous and seamless.

3. The corrugated protective sleeve of claim 1, wherein said wall has opposite lengthwise extending edges extending generally parallel to said longitudinal axis, said edges being configured to be wrapped into overlapping relation with one another.

4. The corrugated protective sleeve of claim 3, wherein said wall includes heat-set weft yarn biasing and maintaining said opposite edges in wrapped, overlapping relation with one another.

5. The corrugated protective sleeve of claim 1, wherein said activatable weft yarn includes monofilament weft yarn.

6. The corrugated protective sleeve of claim 1, wherein said activatable weft yarn includes multifilament weft yarn.

7. The corrugated protective sleeve of claim 1, wherein said non-activatable weft yarn includes monofilament weft yarn.

8. The corrugated protective sleeve of claim 1, wherein said non-activatable weft yarn includes multifilament weft yarn.

9. The corrugated protective sleeve of claim 1, wherein said wall has an outer reflective layer.

10. The corrugated protective sleeve of claim 9, wherein said outer reflective layer includes a layer of metal foil.

11. The corrugated protective sleeve of claim 1, wherein the wall is woven having one of a plain weave pattern, twill weave pattern, satin weave pattern, sateen weave pattern, or basket weave pattern.

12. The corrugated protective sleeve of claim 1, wherein the activatable weft yarn is activatable by at least one of heat, fluid, and/or radiation.

13. The corrugated protective sleeve of claim 12, wherein the activatable weft yarn is activatable by heat.

14. A corrugated protective textile sleeve, comprising:

a flexible, tubular wall of warp yarns and weft yarns woven with one another, said warp yarns extending lengthwise along a longitudinal axis between opposite ends of said tubular wall and said weft yarns extending generally transversely to said warp yarns, at least some of said weft yarns being activated to a shrunken length relative to a length as woven, and at least some said weft yarns being non-activated to retain a length as woven, said non-activated weft yarns forming crests, having a first diameter, spaced axially from one another and said activated weft yarns forming valleys, having a second diameter less than said first diameter, with at least some of said valleys extending between at least some of said crests.

15. A method of constructing a corrugated textile sleeve, comprising:

weaving a flexible wall of including warp yarns, extending lengthwise along a longitudinal axis between opposite ends of said wall, and weft yarns, extending generally transversely to the warp yarns, at least some of said weft yarns being activatable weft yarn and at least some said weft yarns, adjacent said activatable weft yarn, being substantially non-activatable weft yarn;

forming said wall having a tubular configuration; and activating the activatable weft yarn and causing the substantially non-activatable weft yarn to form crests, having a first diameter, spaced axially from one another and causing the activated weft yarn to be shrunken in length to form valleys, having a second diameter less than the first diameter, with at least some of the valleys extending between the crests to provide the wall with a corrugated shape.

16. The method of claim 15, further including weaving the wall being circumferentially continuous and seamless.

17. The method of claim 15, further including weaving the wall having opposite lengthwise extending edges extending generally parallel to the longitudinal axis, with the edges being configured to be wrapped into overlapping relation with one another.

18. The method of claim 17, further including heat-setting at least some of the weft yarn to bias and maintain the opposite edges in wrapped, overlapping relation with one another.

19. The method of claim 15, further including forming an outer reflective layer on an outer surface of the wall.

20. The method of claim 15, further including forming an axially extending length of each valley and of each crest by controlling the number of picks of the respective activatable and non-activatable yarns within each valley and within each crest, weaving the wall having one of a plain weave pattern, twill weave pattern, satin weave pattern, sateen weave pattern, or basket weave pattern, and providing the activatable weft yarn being activatable by at least one of heat, fluid, and/or radiation.

* * * * *